US008578553B2

(12) United States Patent
Conrad

(10) Patent No.: US 8,578,553 B2
(45) Date of Patent: Nov. 12, 2013

(54) SOUND SHIELD FOR A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 326 days.

(21) Appl. No.: 13/041,140

(22) Filed: Mar. 4, 2011

(65) Prior Publication Data

US 2012/0222264 A1 Sep. 6, 2012

(51) Int. Cl.
*A47L 9/22* (2006.01)

(52) U.S. Cl.
USPC ..... 15/326; 15/412

(58) Field of Classification Search
USPC ..... 15/326, 412, 327.2, 327.7
See application file for complete search history.

(56) References Cited

U.S. PATENT DOCUMENTS

| | | | | |
|---|---|---|---|---|
| 1,418,238 | A | 5/1922 | Cramer | |
| 2,884,185 | A | 4/1959 | Dolan | |
| 3,614,860 | A | 10/1971 | Grellsson | |
| 4,655,694 | A * | 4/1987 | Berfield | 417/423.2 |
| 5,067,584 | A | 11/1991 | Williams et al. | |
| 5,078,761 | A | 1/1992 | Dyson | |
| 5,293,664 | A * | 3/1994 | Lim et al. | 15/326 |
| 5,400,463 | A | 3/1995 | Attard et al. | |
| 5,513,417 | A * | 5/1996 | Kim et al. | 15/326 |
| 5,623,744 | A | 4/1997 | Triplett et al. | |
| 5,765,257 | A | 6/1998 | Steger et al. | |
| 5,991,969 | A * | 11/1999 | Lee | 15/326 |
| 6,070,289 | A * | 6/2000 | Lee et al. | 15/326 |
| 6,308,374 | B1 | 10/2001 | Bobrosky et al. | |
| 7,788,763 | B2 * | 9/2010 | Hwang | 15/326 |
| 7,921,510 | B2 * | 4/2011 | Roney et al. | 15/412 |
| 2008/0179133 | A1 | 7/2008 | Conrad | |

FOREIGN PATENT DOCUMENTS

| | | | |
|---|---|---|---|
| CN | 101301180 | A | 11/2008 |
| FR | 2902632 | A1 | 12/2007 |
| WO | 2009026709 | | 3/2009 |

OTHER PUBLICATIONS

International Search Report on the corresponding international patent application No. PCT/CA2012/000187.

* cited by examiner

*Primary Examiner* — Dung Van Nguyen
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprises an air flow path extending from a dirty air inlet to a clean air outlet and includes an air treatment member. A suction motor may be provided in the air flow path. A suction motor housing sidewall may comprise a plurality of openings provided in a first side thereof. An outer housing may comprise a longitudinally extending outer housing sidewall having an outer housing air outlet. At least a portion of the suction motor housing that has the plurality of openings is located in the outer housing and spaced from the longitudinally extending outer housing sidewall to define a passage between the outer housing and the suction motor housing. The outer housing air outlet may be angularly spaced around the outer housing with respect to the first side of the suction motor housing.

18 Claims, 9 Drawing Sheets

SOUND SHIELD FOR A SURFACE CLEANING APPARATUS

FIELD

The disclosure relates to surface cleaning apparatuses, such as vacuum cleaners.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

In one broad aspect, a surface cleaning apparatus having a front end and a rear end, comprises an airflow path extending between a dirty air inlet and a clean air outlet. An air treatment member is provided in the airflow path, preferably upstream from a suction motor. The suction motor is surrounded by an inner motor housing and an outer motor housing. The outer motor housing may comprise the clean air outlet. Air exiting the suction motor passes through a first air outlet on the inner motor housing, and into a chamber defined between the inner and outer motor housings. Air can exit the chamber via the clean air outlet. The first air outlet is not aligned with the clean air outlet thereby causing the air exiting the suction motor to travel through the chamber to an exit of the outer housing. Preferably, the first air outlet is positioned toward an inner side (e.g. the rear side of the inner motor housing if the rear side faces towards a component of the surface cleaning apparatus), and the clean air outlet is positioned on the outer motor housing so as to face outwardly (e.g. the forward side of the inner motor housing if the forward side faces away from a component of the surface cleaning apparatus).

In use, the suction motor can generate noise waves at a given wavelength, and having a given amplitude. The openings preferably have a length that is greater than half of the length of the given wavelengths of the noise generated by the suction motor. The openings preferably have a height and a width that are each less than the amplitude of the noise waves generated by the suction motor.

An advantage of these aspects, used individually or in combination, is that it may help reduce the amount of external noise perceived by a user of the surface cleaning apparatus.

In accordance with these aspects, a surface cleaning apparatus comprises an air flow path extending from a dirty air inlet to a clean air outlet and includes an air treatment member. A suction motor may be provided in a suction motor housing and located in the air flow path. The suction motor housing may comprise an air inlet end, a spaced apart opposed end and a longitudinally extending suction motor housing sidewall positioned therebetween. The suction motor housing sidewall may comprise a plurality of openings provided in a first side thereof. An outer housing may comprise a longitudinally extending outer housing sidewall having an outer housing air outlet. At least a portion of the suction motor housing that has the plurality of openings is located in the outer housing and spaced from the longitudinally extending outer housing sidewall to define a passage between the outer housing and the suction motor housing. The outer housing air outlet may be angularly spaced around the outer housing with respect to the first side of the suction motor housing.

The suction motor may have a suction motor axis. The passage may extend in a plane transverse to the suction motor axis.

The suction motor housing sidewall may have an outer surface that is smooth, and the longitudinally extending outer housing sidewall may have an inner surface that is smooth.

The outer housing air outlet may be the clean air outlet.

The surface cleaning apparatus can also comprise a post motor filter provided in the clean air outlet.

The outer housing air outlet may be angularly spaced from about 90° to about 270° around the outer housing from the first side, and can be spaced from about 135° to about 225° around the outer housing from the first side, and can be spaced about 180° around the outer housing from the first side.

The first side may face forwardly, and the outer housing air outlet may face rearwardly.

The suction motor may produce a sound of at least one particular wavelength that is to be reduced, and the openings can be sized to inhibit travel of the at least one particular wavelength therethrough.

The suction motor may produce a sound of at least one particular wavelength that is to be reduced and the openings have a diameter that is less than an amplitude of the particular wavelength, and the openings may have a length that is greater than half of the particular wavelength.

DRAWINGS

Reference is made in the detailed description to the accompanying drawings, in which.

DETAILED DESCRIPTION

Figure 1:
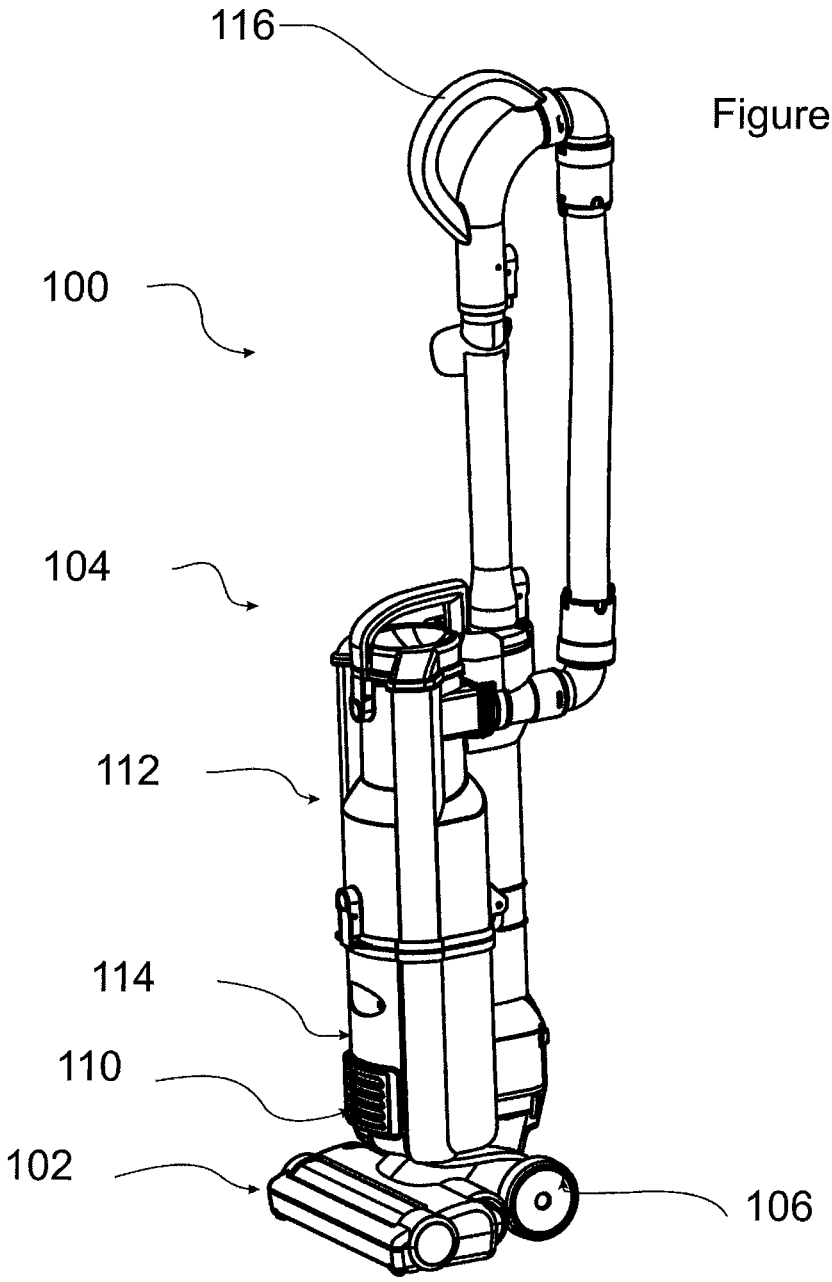
FIG. 1 is a perspective view of a surface cleaning apparatus.

Referring to FIG. 1, an embodiment of a surface cleaning apparatus 100 is shown. In the embodiment illustrated, the surface cleaning apparatus 100 is an upright surface cleaning apparatus. In alternate embodiments, the surface cleaning apparatus may be another suitable type of surface cleaning apparatus, including, for example, a hand vacuum, a canister vacuum cleaner, a stick vac, a wet-dry vacuum cleaner and a carpet extractor.

Referring still to FIG. 1, the surface cleaning apparatus 100 includes a surface cleaning head 102 and an upper section 104. The surface cleaning head 102 includes a pair of rear wheels 106 and a pair of front wheels (not shown) for rolling across a surface and a dirty air inlet 108. The upper section 104 is moveably (e.g., pivotally) connected to the surface cleaning head 102. The upper section 104 is moveable between a storage position and an in use position. An air flow passage extends from the dirty air inlet 108 to a clean air outlet 110 on the upper section 104.

A handle 116 is provided on the upper section 104 for manipulating the surface cleaning apparatus.

Figure 2:
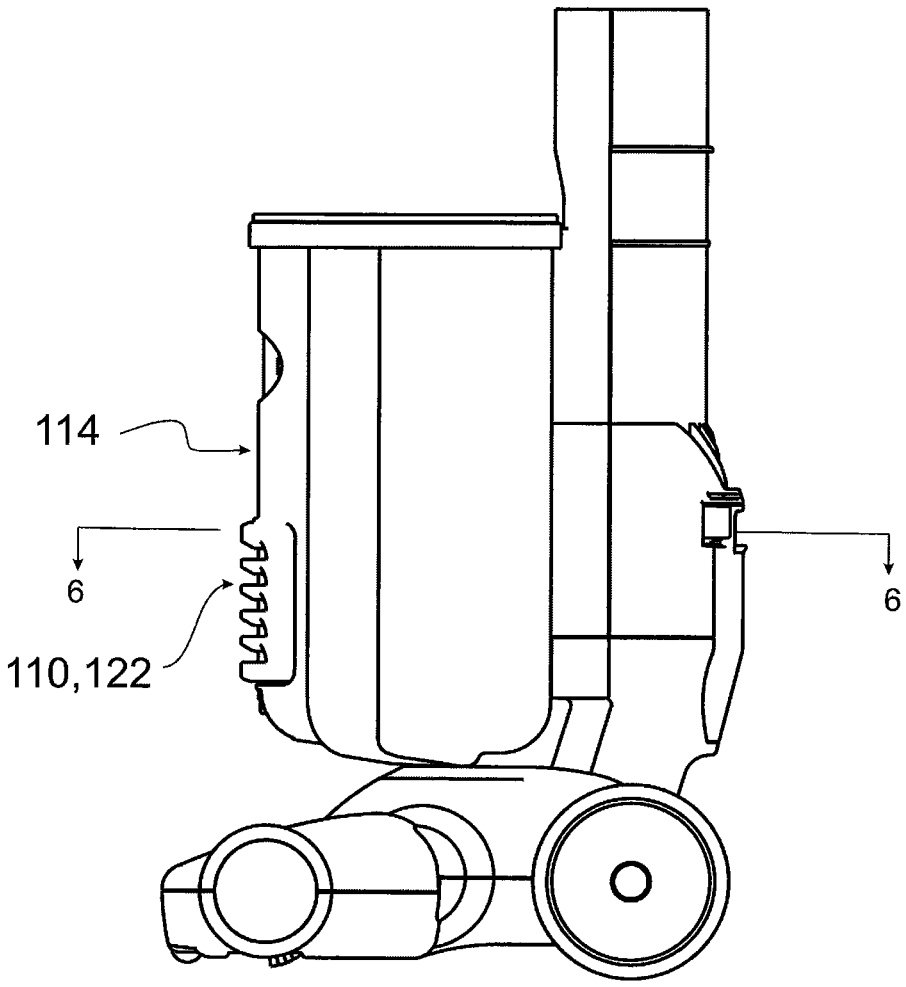
FIG. 2 is a side view of a portion of the surface cleaning apparatus of FIG. 1, with the air treatment housing removed.
Figure 3:
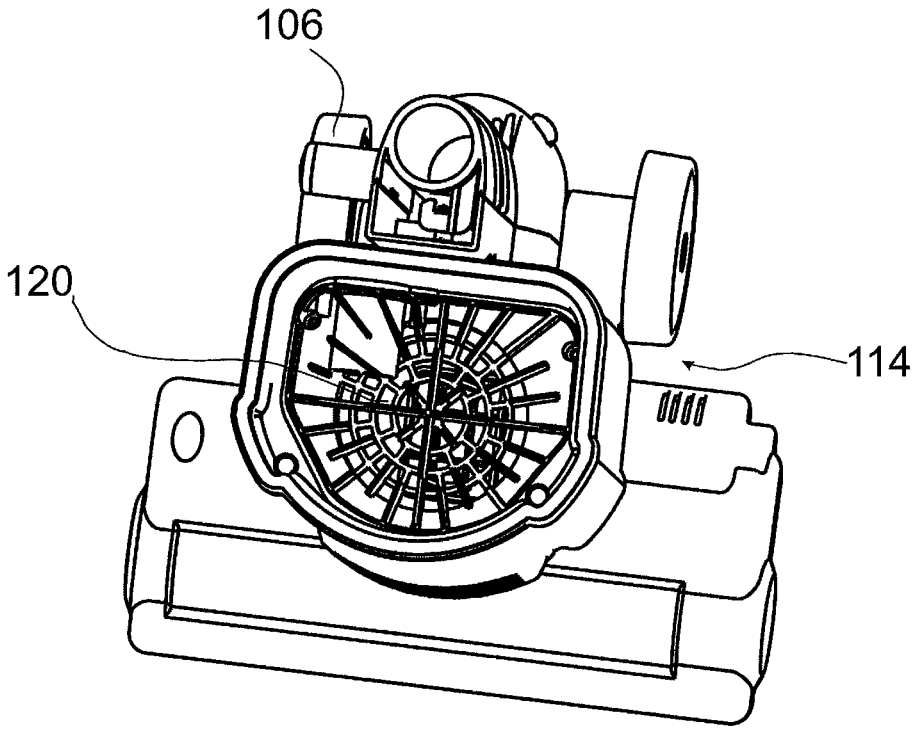
FIG. 3 is a top perspective view of the portion of the surface cleaning apparatus of FIG. 2.

Referring also to FIGS. 2 and 3, the upper section 104 comprises an air treatment housing 112 and a suction motor housing 114. The air treatment housing 112 houses an air treatment member, which is positioned in the air flow passage downstream from the dirty air inlet 108 to remove dirt particles and other debris from the air flowing through the air flow passage. In the illustrated example, the air treatment member comprises a cyclone bin assembly 118. Alternatively, the air treatment member can comprise a bag, a filter or other air treating means.

The suction motor housing 114 is configured to house a suction motor (not shown). The suction motor is in air flow communication with the air flow path, downstream from the cyclone bin assembly 118. Air exiting the cyclone bin assembly 118 can flow into a suction motor inlet 120 and is ejected via a suction motor outlet 122.

When the surface cleaning apparatus 100 is in use, the suction motor can generate a relatively loud noise. Optionally, a sound shield can be provided to help attenuate the sound generated by the suction motor. The sound shield preferably comprises a passage provided between two housings, the passage having an upstream end and a downstream end. The upstream end is in communication with a suction motor chamber in the suction motor housing via a plurality of openings. The downstream end is angularly displaced around the suction motor housing from the upstream end.

Figure 4:
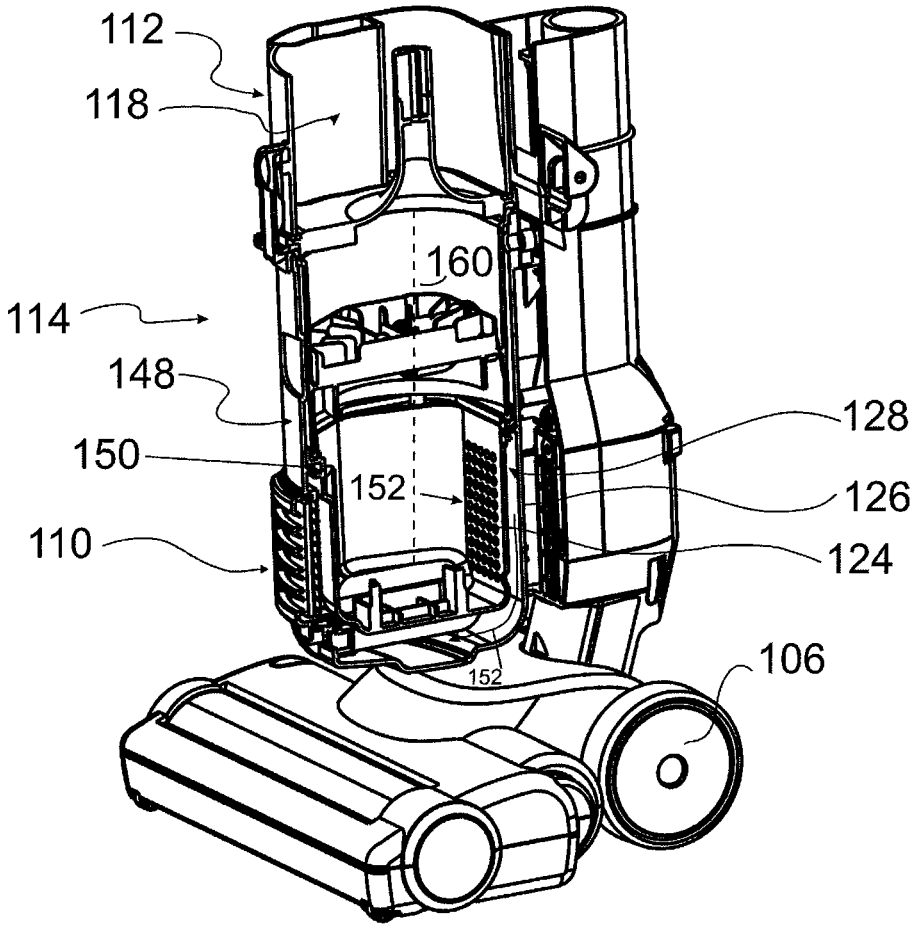
FIG. 4 is a partial cut-away view of one side of the suction motor housing and the air treatment housing of the surface cleaning apparatus of FIG. 1.
Figure 5:
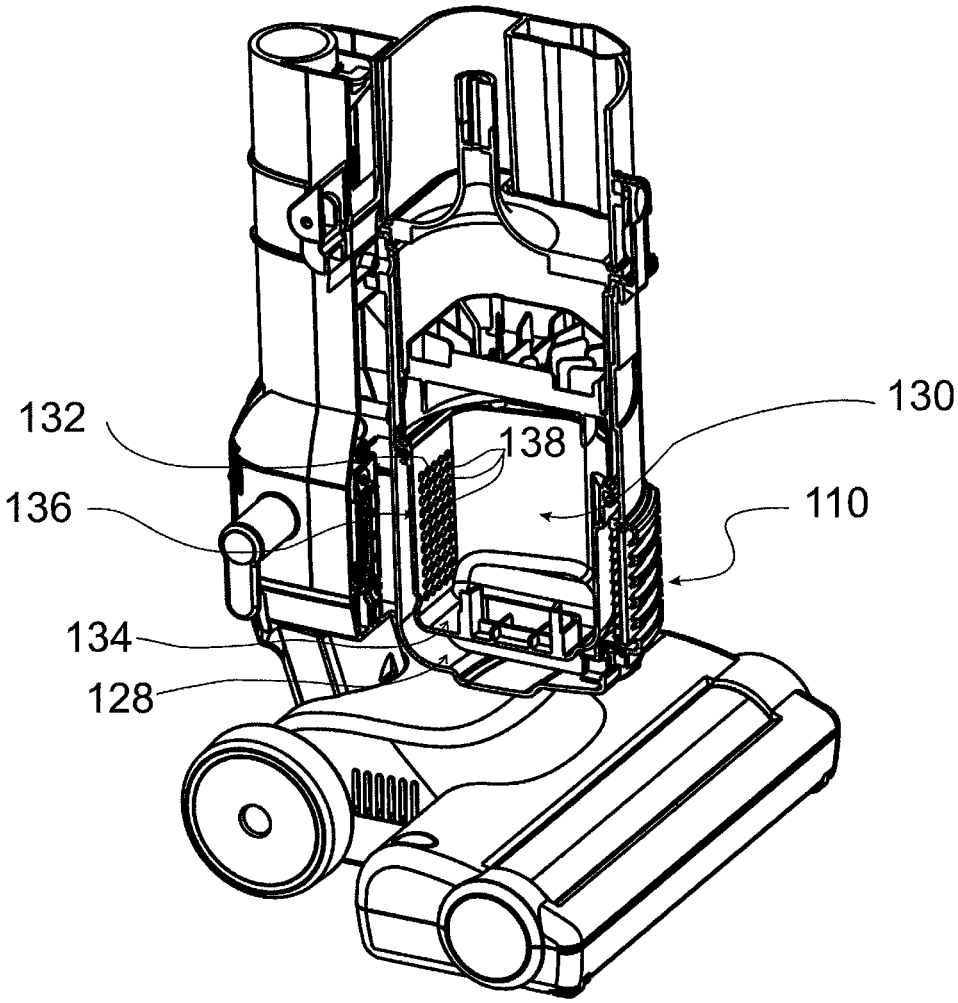
FIG. 5 is a partial cut-away view of the other side of the suction motor housing and the air treatment housing of the surface cleaning apparatus of FIG. 1.

As exemplified in FIGS. 4-7, the sound shield comprises an outer housing and a motor housing spaced inwards of the outer housing so as to define an air flow passage therebetween. As exemplified, motor housing 114 comprises an inner motor housing 124 and an outer motor housing 126. The inner and outer motor housings 124, 126 can extend along a suction motor axis 160 (FIG. 4). An airflow chamber or passage 128 is defined between the inner and outer motor housings 124, 126. In the illustrated example, the airflow chamber 128 has a generally annular cross sectional shape and surrounds at least a portion of the inner motor housing 124.

The inner motor housing 124 comprises a motor cavity or chamber 130 to house a suction motor. The inner motor housing 124 comprises a sidewall 132 surrounding the suction motor cavity 130 and a closed end wall 134 that is opposed to the air inlet end. An opposing end of the inner motor housing 124 (the upper end as illustrated) comprises the air inlet end to receive air from the cyclone bin assembly. The opposed is preferably at least partially closed to prevent a user inserting a finger into the suction motor cavity 130 (e.g., it may be covered by a grill).

Air is drawn into the suction motor cavity 130 through the open end of the inner motor housing 124, and exits the inner motor housing 124 via a motor air outlet 136. In the illustrated example, the motor air outlet 136 comprises a plurality of perforations or openings 138 in the sidewall 132 of the inner motor housing 124. Preferably, the motor air outlet 136 is formed at a location in the side wall 132 that is not aligned with the clean air outlet 110 formed in the outer motor housing 126. For example, the motor air outlet 136 may be angularly spaced from about 90° to about 270° around the inner motor housing 124 from clean air outlet 110, and is preferably spaced from about 135° to about 225° around the inner motor housing 124 from clean air outlet 110, and is still more preferably spaced about 180° around the inner motor housing 124 from clean air outlet 110.

Figure 6:
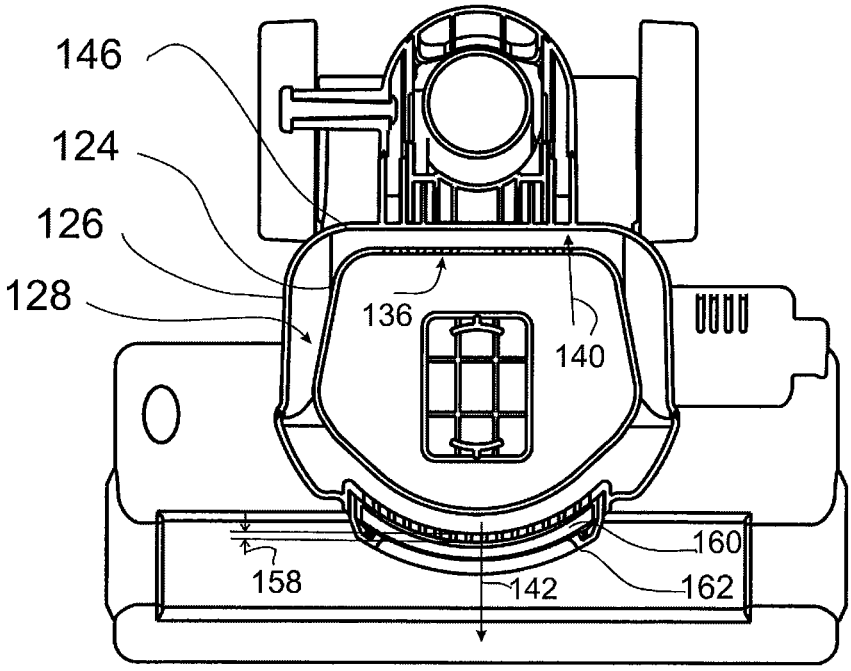
FIG. 6 is a top view of a section taken along line 6-6 in FIG. 2.

More preferably, the motor air outlet 136 is formed in a rear portion of the inner motor housing sidewall 132. Forming the motor air outlet 136 in the rear portion of the inner motor housing 124-142 may help direct air exiting the inner motor housing 124 in a first direction, represented by arrow 140, that is generally opposite to the direction that air exists the clear air outlet 110, represented by arrow 142 (FIG. 6). In this orientation, the motor air outlet 136 faces a component of the surface cleaning apparatus (the base of the upper section as exemplified). Accordingly, sound exiting through the solid rear wall of outer motor housing 126 may be partially absorbed by the base.

Figure 7:
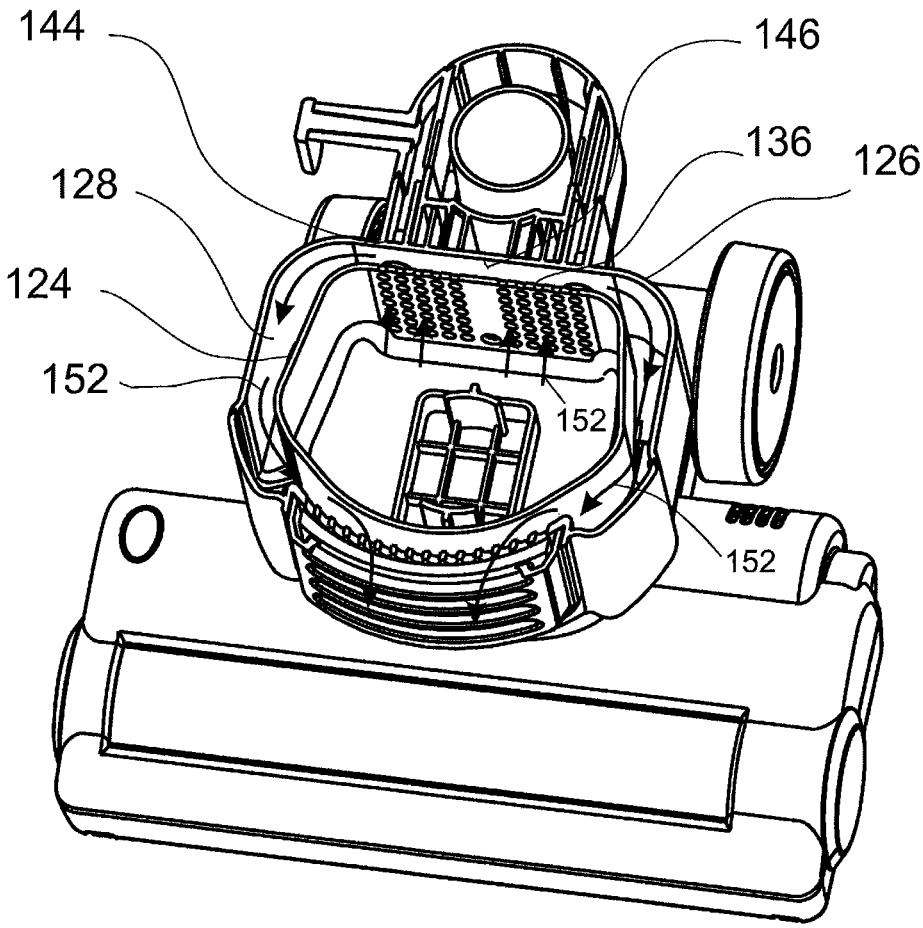
FIG. 7 is a front perspective of the section view of FIG. 6.

Referring to FIG. 7, in the illustrated example, air exiting the motor air outlet 136 flows towards the sidewall 144 of the outer motor housing 126 and is diverted into the airflow chamber 128.

The sidewall 144 of the outer motor housing 126 can be configured to help dampen the sound generated by the suction motor and the air flowing out of the motor air outlet 136. Accordingly, the sidewall 144 may comprise sound dampening features. For example, the sidewall 144 may be formed from a relatively thick layer of material (for example plastic), or may be formed by several layers of material in a stacked configuration. The sidewall 144 can be sized and/or stiffened so that the natural resonant frequency of the sidewall is different than the primary sound frequencies generated by the surface cleaning apparatus 100. Alternatively, or in addition, the portions of the sidewall 144 facing the motor air outlet 136 can comprise sound dampening materials, including for example, rubber and foam.

Preferably, any sound dampening materials and features used in the sidewall 144 are selected to help promote (or at least not hinder) airflow along the inner surface 146 of the sidewall 144, to help direct air from the motor air outlet 136 to the clean air outlet 110.

Passage 128 is preferably rounded (see FIG. 6) and may be generally circular. Rounding the passage 128 will reduce the backpressure produced by the air flowing through passage 128. An advantage of this feature is that the back pressure produced by passage 128 may be reduced permitting use of a smaller motor and/or a higher inlet velocity at the dirty air inlet 108.

Referring to FIG. 4, an upper end 148 of the outer motor housing 126 is sealed by a second end wall 150. Sealing the upper end 148 of the outer motor housing may help prevent air from escaping through the upper end 148 of the airflow chamber 128.

Optionally, the inner surface 146 of the outer motor housing 126 and/or the outer surface of the inner motor housing 124 is preferably configured to promote air flow through the airflow chamber 128, from the motor air outlet 136 to the clean air outlet 110. In the illustrated example, the inner surface 146 of the outer motor housing 126 and the outer surface of the inner motor housing 124 are generally smooth and air can flow around both sides of the inner motor housing 124, and under the sealed end wall 134 of the inner motor housing 124, as represented using arrows 152 (FIGS. 4 and 7).

Preferably, the inner motor housing 124 can be suspended within the outer motor housing 126. Suspending the inner motor housing 124 within the outer motor housing 126 may help reduce the need for airflow-obstructing supporting members extending between the sealed end 134 of the inner motor housing 124 and the outer motor housing 126.

Figure 8:
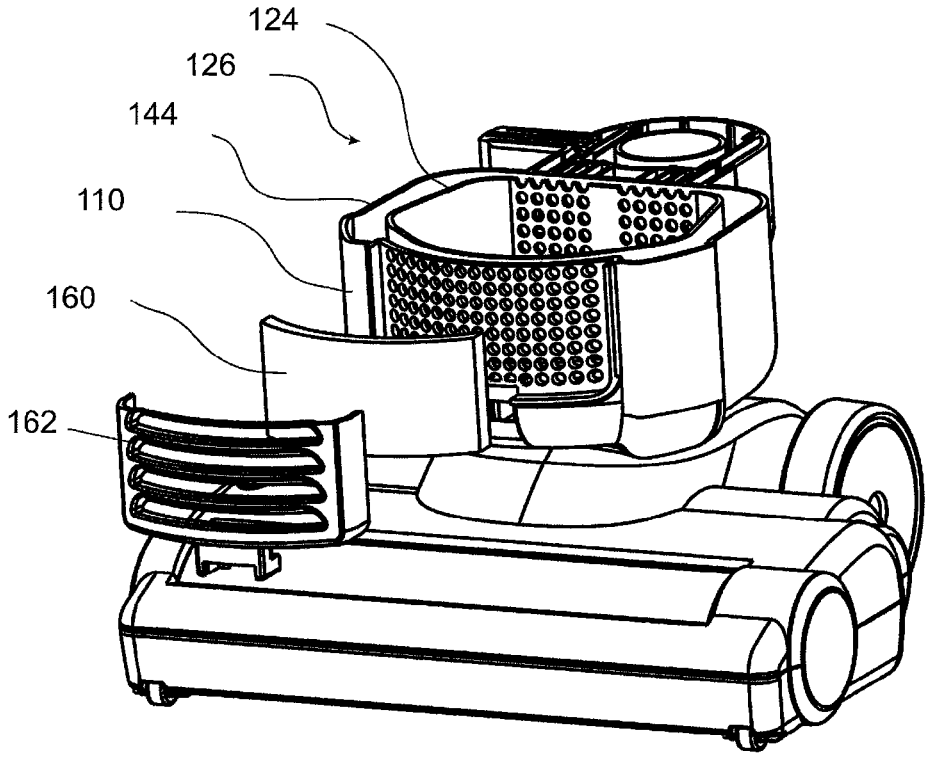
FIG. 8 is a front perspective, partially exploded view of the section view of FIG. 6; and, FIG. 9 is a rear perspective, partially exploded view of the section view of FIG. 6.
Figure 9:
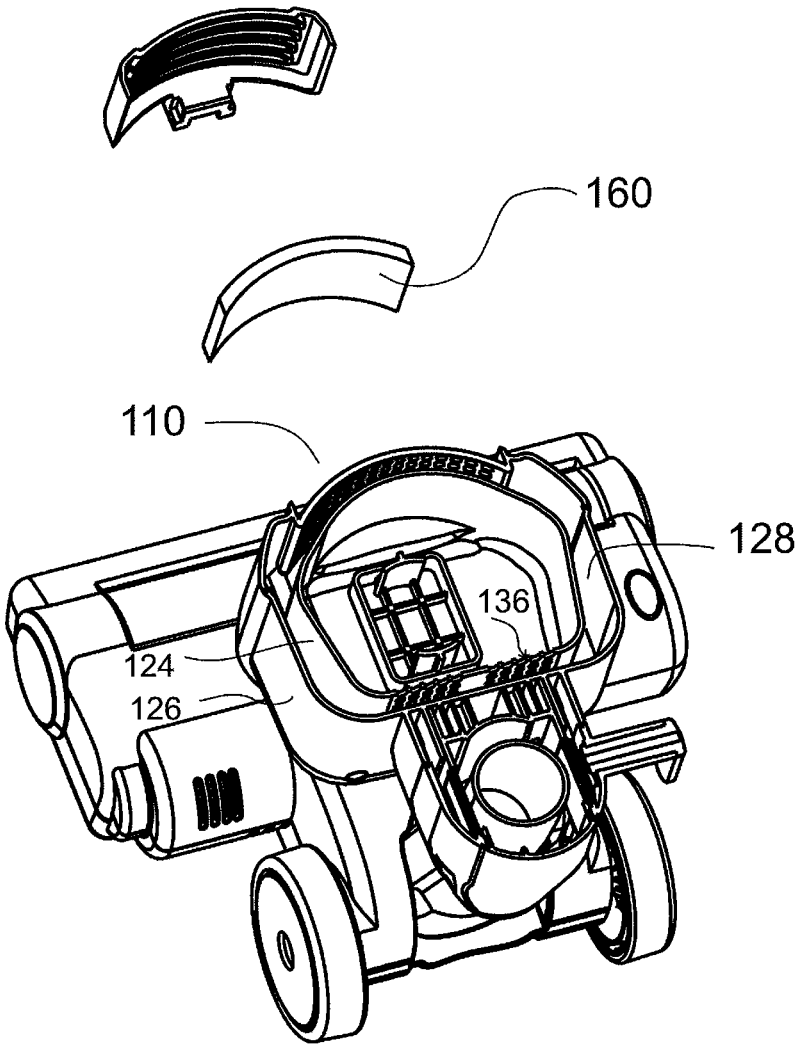

The suction motor may be operable to generate a sounds having a particular wavelength (or range of wavelengths), and a particular amplitude. Referring also to FIGS. 8 and 9, the clean air outlet 110 in the sidewall 144 of the outer motor housing 126 can include a plurality of perforations 154. The size of the perforations 154 can be selected to inhibit the passage of sound waves of one or more particular wavelengths from passing through the perforations 154. For example, the diameter 156 (or the height and the width of the perforations are not circular) of the perforations 154 is preferably selected so that it is generally smaller than the amplitude the sound waves generated by the suction motor, at the particular wavelength that are to be blocked. Accordingly, this will inhibit transport of the sound waves through the perforations.

Alternately, or in addition, the length 158 of the perforations 154 (FIG. 6) can be selected so that it is greater than half of the particular wavelength. Configuring the perforations 154 in this manner may help inhibit selected sound waves from passing through the perforations 154. In the illustrated example, the length 158 of the perforations 154 is generally equal to the thickness of the sidewall 144. However, it will be appreciated that the length 158 of the perforations may be greater than the wall thickness and therefore the perforations may have walls that extend into motor cavity 130 and/or passage 128.

Optionally, a post-motor filter 160 (such as for example a HEPA filter) can be provided downstream from the clean air outlet 110 in the outer motor housing 126. In the illustrated example, the post-motor filter 160 is held in position over the clear air outlet 110 by a grill 162. Preferable, the grill 162 is removable to allow a user to access the post-motor filter 160. Alternatively, in other embodiments the post-motor filter 160 can be positioned in other locations in the air flow path, including, for example covering the motor air outlet 136 in the inner motor housing 124, and being positioned within the airflow chamber 128. It will also be appreciated that clean air outlet may optionally be placed at an alternate location on the surface cleaning apparatus.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

(a) an air flow path extending from a dirty air inlet to a clean air outlet and including an air treatment member;

(b) a suction motor provided in a suction motor housing and located in the air flow path, the suction motor housing comprising an air inlet end, a spaced apart opposed end and a longitudinally extending suction motor housing sidewall positioned therebetween, the suction motor housing sidewall comprising a plurality of openings provided in a first side thereof; and, (c) an outer housing comprising a longitudinally extending outer housing sidewall having an outer housing air outlet, at least a portion of the suction motor housing that has the plurality of openings is located in the outer housing and spaced from the longitudinally extending outer housing sidewall to define a passage between the outer housing and the suction motor housing, the outer housing air outlet is angularly spaced around the outer housing with respect to the first side of the suction motor housing wherein the suction motor produces sound of at least one particular wavelength that is to be reduced and the openings are sized to inhibit travel of the at least one particular wavelength therethrough.

2. The surface cleaning apparatus of claim 1 wherein the suction motor has a suction motor axis and the passage extends in a plane transverse to the suction motor axis.

3. The surface cleaning apparatus of claim 1 wherein the suction motor housing sidewall has an outer surface that is smooth.

4. The surface cleaning apparatus of claim 1 wherein the longitudinally extending outer housing sidewall has an inner surface that is smooth.

5. The surface cleaning apparatus of claim 1 wherein the outer housing air outlet is the clean air outlet.

6. The surface cleaning apparatus of claim 5 further comprising a post motor filter provided in the clean air outlet.

7. The surface cleaning apparatus of claim 1 wherein the outer housing air outlet is angularly spaced from about 90° to about 270° around the outer housing from the first side.

8. The surface cleaning apparatus of claim 7 wherein the outer housing air outlet is angularly spaced from about 135° to about 225° around the outer housing from the first side.

9. The surface cleaning apparatus of claim 7 wherein the outer housing air outlet is angularly spaced about 180° around the outer housing from the first side.

10. The surface cleaning apparatus of claim 1 wherein the first side faces forwardly.

11. The surface cleaning apparatus of claim 10 wherein the outer housing air outlet faces rearwardly.

12. A surface cleaning apparatus comprising:

(a) an air flow path extending from a dirty air inlet to a clean air outlet and including an air treatment member;

(b) a suction motor provided in a suction motor housing and located in the air flow path, the suction motor housing comprising an air inlet end, a spaced apart opposed end and a longitudinally extending suction motor housing sidewall positioned therebetween, the suction motor housing sidewall comprising a plurality of openings provided in a first side thereof; and, (c) an outer housing comprising a longitudinally extending outer housing sidewall having an outer housing air outlet, at least a portion of the suction motor housing that has the plurality of openings is located in the outer housing and spaced from the longitudinally extending outer housing sidewall to define a passage between the outer housing and the suction motor housing, the outer housing air outlet is angularly spaced around the outer housing with respect to the first side of the suction motor housing wherein the suction motor produces sound of at least one particular wavelength that is to be reduced and the openings have a diameter that is less than an amplitude of the particular wavelength.

13. The surface cleaning apparatus of claim 12 wherein the openings have a length that is greater than half of the particular wavelength.

14. The surface cleaning apparatus of claim 12 wherein the first side faces forwardly and the outer housing air outlet faces rearwardly.

15. A surface cleaning apparatus comprising:

(a) an air flow path extending from a dirty air inlet to a clean air outlet and including an air treatment member;

(b) a suction motor provided in a suction motor housing and located in the air flow path, the suction motor housing comprising an air inlet end, a spaced apart opposed end and a longitudinally extending suction motor housing sidewall positioned therebetween, the suction motor housing sidewall comprising a plurality of openings provided in a first side thereof; and, (c) an outer housing comprising a longitudinally extending outer housing sidewall having an outer housing air outlet, at least a portion of the suction motor housing that has the plurality of openings is located in the outer housing and spaced from the longitudinally extending outer housing sidewall to define a passage between the outer housing and the suction motor housing, the outer housing air outlet is angularly spaced around the outer housing with respect to the first side of the suction motor housing wherein the suction motor produces sound of at least one particular wavelength that is to be reduced and the openings have a length that is greater than half of the particular wavelength.

16. The surface cleaning apparatus of claim 15 wherein the first side faces forwardly and the outer housing air outlet faces rearwardly.

17. A surface cleaning apparatus comprising:

(a) an air flow path extending from a dirty air inlet to a clean air outlet and including an air treatment member;

(b) a suction motor provided in a suction motor housing and located in the air flow path, the suction motor housing comprising an air inlet end, a spaced apart opposed end and a longitudinally extending suction motor housing sidewall positioned therebetween, the suction motor housing sidewall comprising a plurality of openings provided in a first side thereof; and, (c) an outer housing comprising a longitudinally extending outer housing sidewall having an outer housing air outlet, at least a portion of the suction motor housing that has the plurality of openings is located in the outer housing and spaced from the longitudinally extending outer housing sidewall to define a passage between the outer housing and the suction motor housing, the outer housing air outlet is angularly spaced around the outer housing with respect to the first side of the suction motor housing wherein the openings have sidewall whose length is greater than a thickness of the suction motor housing.

18. The surface cleaning apparatus of claim 17 wherein the first side faces forwardly and the outer housing air outlet faces rearwardly.

* * * * *